US006641490B2

(12) United States Patent
Ellemor

(10) Patent No.: US 6,641,490 B2
(45) Date of Patent: Nov. 4, 2003

(54) GOLF CLUB HEAD WITH DYNAMICALLY MOVABLE CENTER OF MASS

(76) Inventor: John Warwick Ellemor, 26/450 Esplanade, Palm Beach, Queensland (AU), 4221

( * ) Notice: Subject to any disclaimer, the term of this patent is extended or adjusted under 35 U.S.C. 154(b) by 0 days.

(21) Appl. No.: 10/081,030

(22) Filed: Feb. 11, 2002

(65) Prior Publication Data

US 2002/0082114 A1 Jun. 27, 2002

(30) Foreign Application Priority Data

Aug. 18, 1999 (AU) ..... PQ2279

(51) Int. Cl.[7] ..... A63B 53/04
(52) U.S. Cl. ..... 473/326; 473/333
(58) Field of Search ..... 473/324, 333, 473/334, 335, 336, 282, 291, 256, 231, 219, 326, 345, 350

(56) References Cited

U.S. PATENT DOCUMENTS 1,561,595 A * 11/1925 Davis
3,951,413 A * 4/1976 Bilyeu
3,993,314 A * 11/1976 Harrington
4,135,720 A * 1/1979 Lancellotti
4,655,458 A * 4/1987 Lewandowski
4,944,515 A * 7/1990 Shearer
5,082,279 A * 1/1992 Hull
5,195,747 A * 3/1993 Choy
5,366,222 A * 11/1994 Lee
5,451,058 A * 9/1995 Price
5,628,697 A * 5/1997 Gamble
5,776,009 A * 7/1998 McAtee
5,803,829 A * 9/1998 Hayashi
5,890,973 A * 4/1999 Gamble
6,017,280 A * 1/2000 Hubert
6,149,533 A * 11/2000 Finn

FOREIGN PATENT DOCUMENTS

JP 09168612 A 6/1976

* cited by examiner

*Primary Examiner*—Sebastiano Passaniti

(57) ABSTRACT

A golf club, namely a driver, includes a flowing moving part within the head such as mercury or a flowable solid in an inclined U shaped hollow passage (11). The moving part (12) remains captive at the rear of the head during the downswing on an axis defined by the direction of travel and the center of mass. A golf ball impacting the head away from this axis e.g. at the toe (17) causes the head to rotate and subsequently causing the flowing moving part (18) and hence the center of mass to move to behind the point of impact i.e. the toe, thus reducing head rotation head rotation and increasing the sweet spot.

9 Claims, 1 Drawing Sheet

GOLF CLUB HEAD WITH DYNAMICALLY MOVABLE CENTER OF MASS

TECHNICAL FIELD

This invention relates to golf clubs and in particular to drivers.

SUMMARY OF THE INVENTION

This invention reveals a golf club that has built into it's head, a movable material that in play moves to cause the center of gravity to shift. The material referred to can be a fluid, such as mercury or it could be small metal spheres. All further references to "mercury" shall also be taken to mean 'small metal spheres'. The mercury will be confined to a relatively small area in a modified "U" shaped passage contained inside the head and be constrained by centrifugal force during the downward swing of the club that takes place just before the golf ball is struck in the course of play to an area usually positioned at the lowest part of the passage and well back toward the rear of the head. Upon impacting a golf ball and the subsequent slowing of the head's fixed parts, the mercury continues to move forward at or close to the speed of the club at impact. The position impacted on the face of the club will dictate whether the mercury divides, as would be the case with a center hit ball, or if a ball is struck well off center, all or the greater part of the mercury will be driven by kinetic energy into that sector of the passage leading to the struck area and with areas struck between these two positions causing the mercury to divide in proportions that match the impact point.

The present invention thus provides a golf club namely a driver, having a driver head, the head having a toe and a heel at opposite ends of a ball striking face for application of an impact force to a golf ball and a sole on the underside thereof, a shaft extending from the head, a surface within the head on the rear side of the ball striking face for application of a secondary impact force to a golf ball, a hollow passage within the head, the passage having first and second ends terminating at the rear surface at first and second positions on opposite sides of a central impact zone on the ball striking face, the hollow passage being arranged such that when the sole is supported on level ground with the ball striking face substantially upright, the hollow passage is inclined from the first and second positions downwardly and rearwardly from the rear surface of the ball striking face, and a liquid or flowable solid partly filling the passage, whereby upon downswing of the golf club, the liquid or flowable solid under the influence of centrifugal force will locate in a region of the passage intermediate the ends thereof and spaced from the rear surface and wherein the liquid or flowable solid will divide for application of a secondary impact force to the rear surface at the first and second positions where a golf ball is impacted by the ball striking face at or adjacent the central impact zone and wherein the liquid or flowable solid or the majority thereof will be directed for application of a secondary impact force on the rear surface at the first or second position depending upon which position is adjacent the point of impact of the ball striking face upon a golf ball.

DETAILED DESCRIPTION OF THE DRAWINGS

ITEMS identified in capitals followed by a number in parenthesis, feature in the following examples. All further references to 'driver' shall be taken to mean 'the body of the club's head'. Both drawings represent forged titanium castings, shown less their upper plates which would complete their heads. Positions of internal parts that would be concealed within another parts, are outlined with interrupted lines.

EXAMPLE 1

Figure 2:
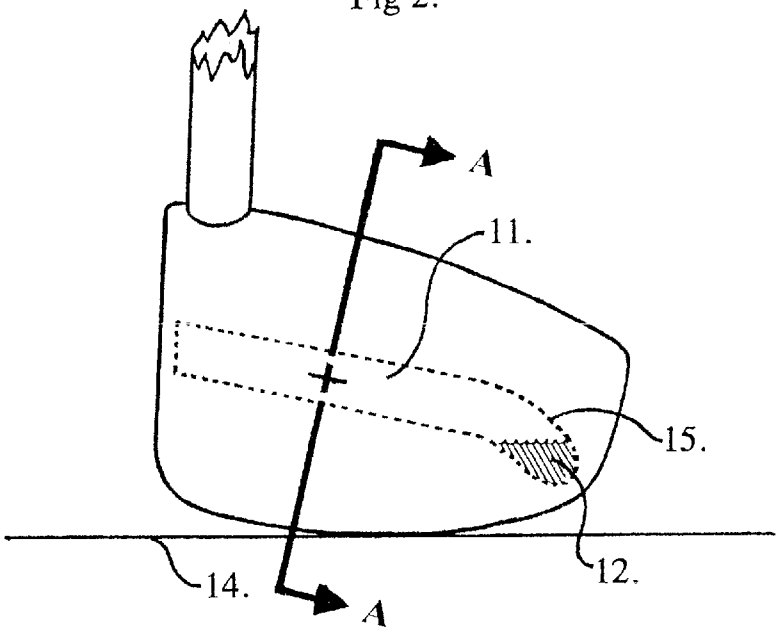
FIG. 2 is a end view of the driver of FIG. 1 from the heel.

Disclosed is the construction of a DRIVER (10). Within it's body a PASSAGE typically a tube (11) is located and is partly filled with MERCURY (12), the passage is preferably circular in cross section, it is shaped so as when seen from a vertical perspective (FIG. 1.), it represents approximately half a circle with ends that extending to equal distances each side of a vertical line through the center of the driver's FACE (13). With it resting on FLAT GROUND (14) A horizontal view from the side (FIG. 2.) also reveals the position occupied by the passage, it indicates that the passage slopes downward from the face. It also indicates that the curved sector at the back also curves even FURTHER DOWNWARD (15) and contains the mercury. When playing a stroke the mercury will move from this position as the club swings upward but will quickly resume this earlier position under the influence of centrifugal force as the down stroke increases in speed on it's way to striking the golf ball. The action that can be expected when the driver is used may best be described by relating to two different strokes.

THE FIRST STROKE shall describe what occurs when a Golf ball is struck by the face of the club on or near to a vertical line in the center it's face. As the face comes into contact with the ball, the force causes the shape of the ball to flatten at the point of contact. In the brief time that this compression is occurring, the driver, as it transfers pressure to the ball, also causes it's velocity to decrease. This drop in velocity strictly relates to the driver's rigid parts, so the mercury now moves unhindered toward the face. As the impact was at or close to the center of the face, the mercury will divide with about half moving to either side of the center. Thus the divided mercury will reinforce the impact of a well hit ball and should produce a drive in the direction intended.

Figure 1:
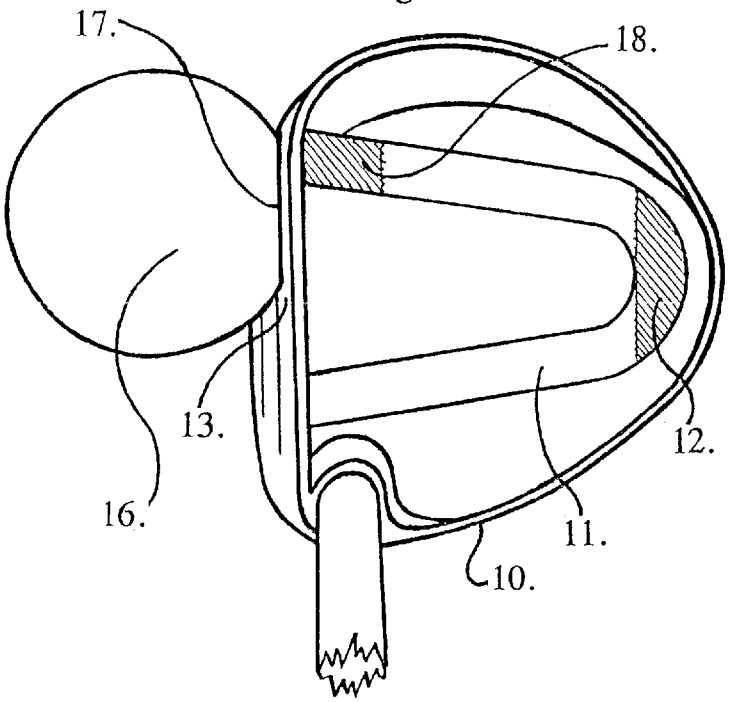
FIG. 1 is cut-away view from above of the driver of the invention.

THE SECOND STROKE relates to a GOLF BALL(16) that was struck well off center. In this case as the ball is contacting the TOE (17) and begins to be compressed, a twisting motion of the shaft also occurs, and although it is limited by the grip the golfer has on the shaft, the small kick clockwise as the driver slows, is enough so that the mercury, which up until the point of contact with the ball was able to remain at the back of the passage. Now expends it's kinetic energy and the twisting causes by far the greater part of the mercury to be directed into the side leading to the toe. As the mercury impacts the rear of the club's face, it moves the center of gravity toward the passage's OUTER END (18) & (FIG. 1). Contact with the ball at other points nearer the center of the face will divide the mercury in unequal portions and provide an appropriate secondary impact.

Figure 4:
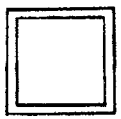
FIGS. 3 and 4 are enlarged sectional views of the hollow passage in the driver head taken along line A—A of FIG. 2 showing alternative sections of the passage.
Figure 3:
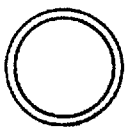

The descriptions and the drawings are given only as examples and application of this invention and is not limited to them alone. Many variations are anticipated. other changes anticipated relate to the cross sectional shape of the fluid passage, it could be square or some other cross sectional shape (see FIGS. 3 and 4). It could also change from the suggested modified "U" shape and be entirely circular as viewed from above and used in contact to the rear of the club's face or part of the circle only may be used or it could be asymmetric and be attached at a diagonal angle. It could also be partly shaped as the lower part of the driver as it is forged or fabricated and completed to retain the fluid with a plate attached later. In all such cases the suggested lower rear sector could dip or remain on a single plain. These and other shapes or modifications may be made to the foregoing without departing from the scope of this invention as set forth in the preceding description and in the claims that follow. Such variations and many others will prove effective to put this invention into practice and would of course, adhere to the general principal.

What is claimed is:

1. A golf club, having a driver head, the head having a toe and a heel at opposite ends of a ball striking face for application of an impact force to a golf ball and a sole on the underside thereof, a shaft extending from the head, a surface within the head on the rear side of the ball striking face for application of a secondary impact force to a golf ball, a hollow passage within the head, the passage having first and second ends terminating at the rear surface at first and second positions on opposite sides of a central impact zone on the ball striking face, the hollow passage being arranged such that when the sole is supported on level ground with the ball striking face substantially upright, the hollow passage is inclined from the first and second positions downwardly and rearwardly from the rear surface of the ball striking face, and a liquid or flowable solid partly filling the passage, whereby upon downswing of the golf club, the liquid or flowable solid under the influence of centrifugal force will locate in a region of the passage intermediate the ends thereof and spaced from the rear surface and wherein the liquid or flowable solid will divide for application of a secondary impact force to the rear surface at the first and second positions where a golf ball is impacted by the ball striking face at or adjacent the central impact zone and wherein the liquid or flowable solid or the majority thereof will be directed for application of a secondary impact force on the rear surface at the first or second position depending upon which position is adjacent the point of impact of the ball striking face upon a golf ball.

2. A golf club as claimed in claim 1 wherein the intermediate region of the passage has in plan view a substantially arcuate configuration about a radius.

3. A golf club as claimed in claim 2 wherein the passage has substantially linear portions which extend from the intermediate region to the first and second positions respectively on the rear face.

4. A golf club as claimed in claim 2 wherein a portion of the intermediate region of the passage extends downwardly from the remainder of the intermediate region to define a container for the liquid or flowable solid.

5. A golf club as claimed in claim 4 wherein when the golf club is on level ground with the striking face substantially upright, the first position is adjacent the heel and the second position is adjacent the toe and the second position is located higher than the first position.

6. A golf club as claimed in claim 1 wherein the fluid comprises mercury.

7. A golf club as claimed in claim 1 wherein the flowable solid comprises a plurality of spheres.

8. A golf club as claimed in claim 1 wherein the hollow passage is uniform in cross section.

9. A golf club as claimed in claim 8 wherein the hollow passage is circular or square in cross section.

* * * * *